US009580888B2

(12) United States Patent
Ahn et al.

(10) Patent No.: US 9,580,888 B2
(45) Date of Patent: Feb. 28, 2017

(54) APPARATUS AND METHOD FOR CONTROLLING OIL HYDRAULIC PUMP FOR EXCAVATOR

(71) Applicant: Doosan Infracore Co., Ltd., Incheon (KR)

(72) Inventors: Min Ha Ahn, Seoul (KR); Woo Yong Jung, Seoul (KR); Dal Sik Jang, Seoul (KR); Hyeon Sik Ahn, Seoul (KR); Kwang Ho Lim, Seoul (KR)

(73) Assignee: Doosan Infracore Co., Ltd., Incheon (KR)

( * ) Notice: Subject to any disclaimer, the term of this patent is extended or adjusted under 35 U.S.C. 154(b) by 0 days.

(21) Appl. No.: 14/766,181

(22) PCT Filed: Feb. 6, 2014

(86) PCT No.: PCT/KR2014/001019
§ 371 (c)(1),
(2) Date: Aug. 13, 2015

(87) PCT Pub. No.: WO2014/123368
PCT Pub. Date: Aug. 14, 2014

(65) Prior Publication Data

US 2015/0376871 A1 Dec. 31, 2015

(30) Foreign Application Priority Data

Feb. 8, 2013 (KR) ..... 10-2013-0014269

(51) Int. Cl.
*E02F 9/22* (2006.01)
*F15B 11/17* (2006.01)

(52) U.S. Cl.
CPC ..... *E02F 9/2242* (2013.01); *E02F 9/2228* (2013.01); *E02F 9/2267* (2013.01);
(Continued)

(58) Field of Classification Search
CPC ..... F15B 11/17; F15B 2211/20576; F15B 2211/265; F15B 2211/71; F15B 2211/78;
(Continued)

(56) References Cited

U.S. PATENT DOCUMENTS 9,022,749 B2 * 5/2015 Akiyama ..... E02F 9/123 417/212
2002/0037211 A1 * 3/2002 Korycan ..... B60P 1/167 414/501

(Continued)

FOREIGN PATENT DOCUMENTS

CN 102762797 10/2012
KR 20-1992-008658 7/1990

(Continued)

OTHER PUBLICATIONS

International Search Report for International Patent Application PCT/KR2014/001019 mailed May 23, 2014. 5 pages.

(Continued)

*Primary Examiner* — Atul Trivedi
(74) *Attorney, Agent, or Firm* — K&L Gates LLP

(57) ABSTRACT

An exemplary embodiment of the present specification relates to an apparatus for controlling a hydraulic pump for an excavator with respect to a change of an operation mode, the apparatus including: an operating unit configured to generate an operation signal according to an operation of an operator, and including a joystick or a pedal; an oil flow supplying unit configured to supply oil to actuators, in order to drive a plurality of actuators corresponding to the operation signal, and including a plurality of pumps and a plurality of logic valves; and a control unit configured to control the oil flow supplying unit by using a priority algorithm for each operation considering a use frequency and a load of the actuator with respect to a change of a (Continued)

predetermined operation mode according to the operation signal.

13 Claims, 3 Drawing Sheets

(52) U.S. Cl.
CPC ..... *E02F 9/2289* (2013.01); *E02F 9/2292* (2013.01); *E02F 9/2296* (2013.01); *F15B 11/17* (2013.01); *F15B 2211/20576* (2013.01); *F15B 2211/265* (2013.01); *F15B 2211/71* (2013.01); *F15B 2211/78* (2013.01)

(58) Field of Classification Search
CPC F15B 13/044; F15B 15/02; E02F 9/22; E02F 9/2267; E02F 9/2289; E02F 9/2292; E02F 9/2296; E02F 9/2242; E02F 9/2228; E02F 9/20; E02F 3/65
USPC ..... 701/50
See application file for complete search history.

(56) References Cited

U.S. PATENT DOCUMENTS

2004/0035103 A1* 2/2004 Nagura ..... F15B 1/024 60/414
2006/0048508 A1* 3/2006 Nakamura ..... E02F 9/2228 60/422
2007/0101708 A1* 5/2007 Ohigashi ..... E02F 9/2235 60/431
2008/0300757 A1* 12/2008 Kanayama ..... E02F 9/2025 701/50
2009/0056324 A1* 3/2009 Itakura ..... E02F 9/2228 60/421
2009/0320461 A1* 12/2009 Morinaga ..... B66F 9/22 60/431
2010/0319338 A1* 12/2010 Ikeda ..... E02F 9/123 60/468
2011/0020146 A1* 1/2011 Akiyama ..... E02F 9/123 417/213
2011/0056192 A1* 3/2011 Weber ..... E02F 9/2242 60/327
2011/0056194 A1 3/2011 Wojcicki et al.
2012/0003069 A1* 1/2012 Hagiwara ..... E02F 9/226 414/685
2012/0067432 A1* 3/2012 Vigholm ..... E02F 9/2217 137/14
2012/0067443 A1* 3/2012 Horii ..... E02F 9/2239 137/599.01
2012/0093624 A1* 4/2012 Ohhigashi ..... E02F 9/2203 414/722
2012/0185141 A1* 7/2012 Kamado ..... E02F 9/2066 701/50
2012/0279211 A1* 11/2012 Jang ..... E02F 9/2217 60/459
2012/0310492 A1* 12/2012 Karasawa ..... E02F 9/2253 701/50
2013/0000478 A1* 1/2013 Cho ..... E02F 3/435 91/516
2013/0345939 A1* 12/2013 Magaki ..... E02F 9/2214 701/50

FOREIGN PATENT DOCUMENTS

KR 10-20050083302 8/2005
KR 10-2008-0016589 2/2008
KR 10-2009-0070522 7/2009
KR 10-2011-0074367 6/2011

OTHER PUBLICATIONS

Chinese Office Action issued for related Chinese Patent Application 201480008001.9 on Jun. 3, 2016. 6 pages.
Extended European search report issued Oct. 5, 2016 in corresponding European application No. 14748792.0 (6 pages).

* cited by examiner

APPARATUS AND METHOD FOR CONTROLLING OIL HYDRAULIC PUMP FOR EXCAVATOR

CROSS REFERENCE TO RELATED APPLICATIONS

The present application is a National Stage of International Application No. PCT/KR2014/001019, filed on Feb. 6, 2014, which claims priority to Korean Patent Application No. 10-2013-0014269, filed on Feb. 8, 2013, the entire contents of each of which are being incorporated herein by reference.

TECHNICAL FIELD

The present disclosure relates to a method of controlling a hydraulic pump for an excavator with respect to a change of an operation mode.

BACKGROUND ART

An excavator, which is a construction machine performing an excavating operation for digging in the ground at a civil engineering site, a building site, and a construction site, a loading operation of transporting earth and sand, a crushing operation for braking a structure, a tillage operation for organizing the ground, and the like, is formed of a front attachment including a travelling body serving to move equipment, an upper turning body mounted on the travelling body and rotated 360°, a boom and an arm rotatably connected with the upper turning body, and options, such as a bucket and a breaker, attached to an end of the arm, and the excavator needs to be able to exert large force when performing the operations, so that oil pressure is mainly used.

The excavator using oil pressure includes an engine providing power, a pump supplying oil to a cylinder connected to each actuator, and a value determining oil supplied to each cylinder.

When the cylinder is desired to be operated at a speed corresponding to an operation of a joystick by a user, only a predetermined oil needs to pass through the cylinder by generating a difference in pressure between a pump and a cylinder generated by a valve spool, and the oil is inevitably lost due to a difference in pressure between front and rear ends of the valve. The loss of the oil at the valve is the biggest reason for losing the entire oil pressure of the excavator, so that the loss of the oil pressure may be decreased by excluding a use of the valve spool, directly controlling oil of the pump, and supplying the oil to the cylinder.

That is, when the pump is directly controlled, the valve spool is not used, and thus oil of the pump at the same pressure cannot be appropriately distributed to each cylinder, so that one pump needs to be connected to one cylinder. However, the number of pumps may be limited due to a limit of an internal space of a vehicle. When the number of pumps is limited as described above, a logic valve for assigning a pump to each cylinder according to an operation of a joystick case by case may be used.

DISCLOSURE

Technical Problem

In order to minimize a change of a logic valve and decrease oil pressure loss, a method of minimizing a change of an operation mode according to a change of an operation of a joystick by researching an operation pattern in a single operation or a complex operation of an excavator and assigning a weighted value for each operation of a cylinder from the point of view that a simultaneous use frequency is high or a load during an operation is large is required.

The present disclosure is conceived so as to solve the problems in the related art, and an object of the present disclosure is to provide an apparatus and a method of controlling a hydraulic pump for an excavator, which minimize a change in a logic valve by using a priority algorithm with respect to a change of an operation mode.

Technical Solution

In order to achieve the aforementioned object, an exemplary embodiment of the present specification relates to provide an apparatus for controlling a hydraulic pump for an excavator, including: an operating unit configured to generate an operation signal according to an operation of an operator, and including a joystick or a pedal; an oil flow supplying unit configured to supply oil to actuators, in order to drive a plurality of actuators corresponding to the operation signal, and including a plurality of pumps and a plurality of logic valves; and a control unit configured to control the oil supplying unit by using a priority algorithm for each operation considering a use frequency and a load of the actuator with respect to a change of a predetermined operation mode according to the operation signal.

Another exemplary embodiment of the present specification provides to a method of controlling a hydraulic pump for an excavator with respect to a change of an operation mode according to an operation signal, the method including: checking whether an operation signal corresponding to a travelling device is input, and preferentially assigning two pumps to the travelling device when the operation signal corresponding to the travelling device is input; checking whether an operation signal corresponding to an auxiliary device is input, and when the operation signal corresponding to the auxiliary device is input, assigning one pump to the auxiliary device; checking whether an operation signal corresponding to a swing is input, and when the operation signal corresponding to the swing is input, assigning one pump to the swing; checking whether an operation signal corresponding to a boom is input and when the operation signal corresponding to the boom is input, assigning two pumps to the boom when the number of actuators, which are required to be driven, is smaller than the number of total pumps, and assigning one pump to the boom when the number of actuators, which are required to be driven, is larger than or equal to, the number of total pumps; checking whether an operation signal corresponding to an arm is input and when the operation signal corresponding to the arm is input, assigning two pumps to the arm when the number of actuators, which are required to be driven, is smaller than the number of total pumps, and assigning one pump to the arm when the number of actuators, which are required to be driven, is larger than or equal to the number of total pumps; and checking whether an operation signal corresponding to a bucket is input and when the operation signal corresponding to the bucket is input, assigning one pump to the bucket.

Effects

According to an exemplary embodiment of the present disclosure, it is possible to directly control oil by using a logic valve, thereby improving control accuracy and improving fuel efficiency of an operation of an excavator.

Further, it is possible to supply oil to one or more actuators by one pump, thereby decreasing the number of pumps.

Further, it is possible to improve an operation speed by an increase of oil flow in a complex operation by mapping a pump and a cylinder.

DETAILED DESCRIPTION OF CERTAIN INVENTIVE EMBODIMENTS

It should be noted that technical terms used in the present specification are used only to describe a specific exemplary embodiment, and do not intend to limit the present disclosure.

Further, the singular forms used in the present specification include the plural forms, unless the context clearly indicates otherwise. In the present application, a term, "comprise" or "include" shall not be construed as essentially including several constituent elements or several steps described in the specification, and it shall be construed that some constituent elements or some steps may not be included, or additional constituent elements or steps may be further included. Further, suffixes, "module" and "unit", for components used in the present specification are given or mixed and used by considering easiness in preparing a specification and do not have a meaning or role distinguished from each other in themselves.

Terms including ordinal numbers, such as "first" and "second", used in the present specification may be used for describing various constituent elements, but the constituent elements should not be limited by the terms. The above terms are used only to discriminate one component from another component. For example, without departing from the scope of the present disclosure, the first component may be referred to as the second component and similarly, the second component may also be referred to as the first component.

In describing the present disclosure, when it is determined that the detailed description of the known art related to the present disclosure may obscure the gist of the present disclosure, the detailed description thereof will be omitted. Further, it is noted that the accompanying drawings are used just for easily appreciating the spirit of the present disclosure and it should not be analyzed that the spirit of the present disclosure is limited by the accompanying drawings.

Figure 1:
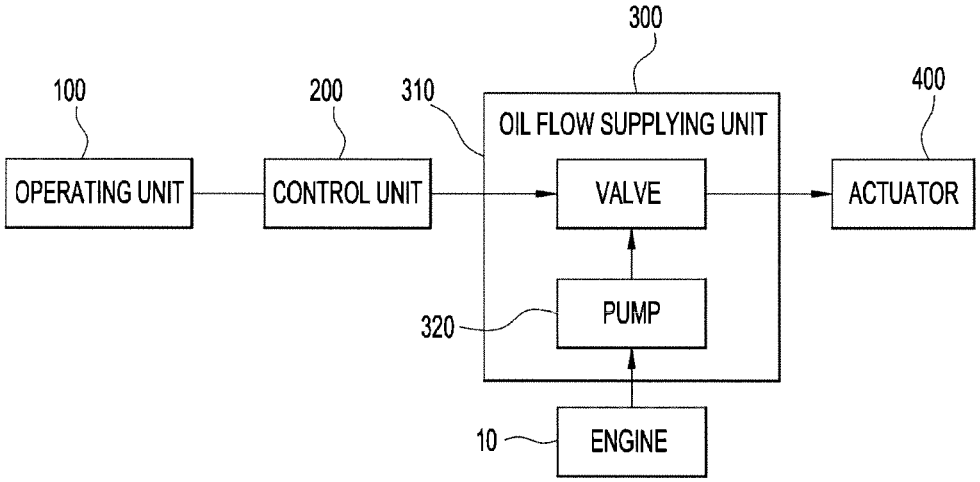
FIG. 1 is a configuration diagram illustrating an example of an apparatus for controlling a hydraulic pump for an excavator according to an exemplary embodiment of the present disclosure.

FIG. 1 is a configuration diagram illustrating an example of an apparatus for controlling a hydraulic pump for an excavator according to an exemplary embodiment of the present disclosure.

As illustrated in FIG. 1, the apparatus for controlling a hydraulic pump for an excavator includes an operating unit 100, a control unit 200, an oil flow supplying unit 300, and an actuator 400.

When an operator operates a joystick or a pedal, the operating unit 100 generates an operation signal corresponding to the operation of the joystick or the pedal.

The control unit 200 controls the oil flow supplying unit 300 by using a priority algorithm for each operation considering a use frequency and a load with respect to a change of an operation mode according to the operation signal. The priority algorithm for each operation will be described below.

Figure 2:
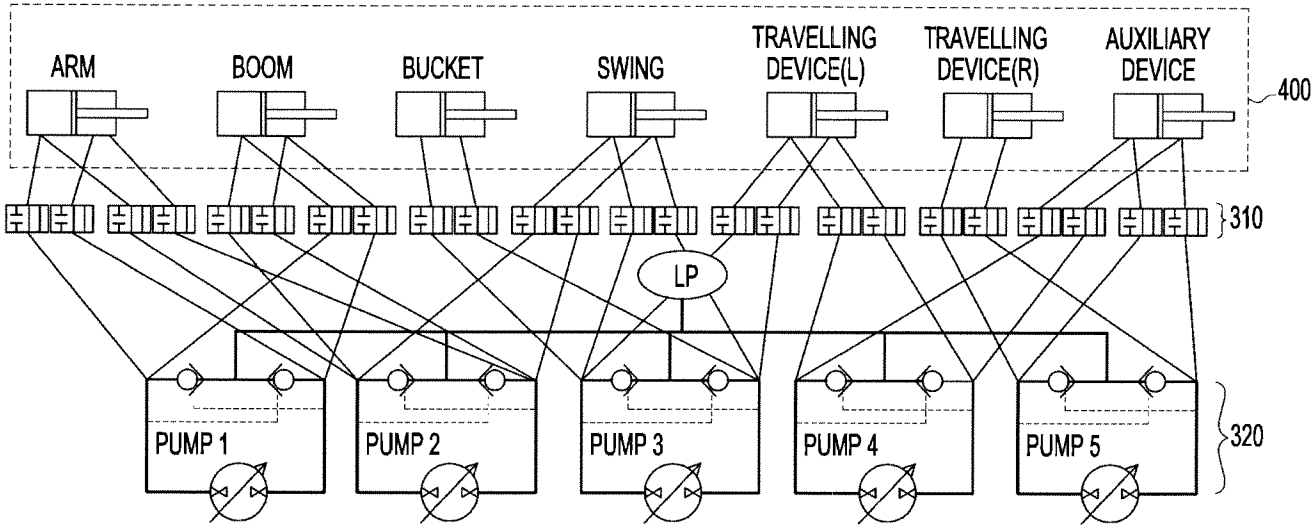
FIG. 2 is a configuration diagram illustrating an example of an oil flow supplying unit of an excavator according to an exemplary embodiment of the present disclosure.

The oil flow supplying unit 300 includes a plurality of pumps 320 and a plurality of valves 310, and supplies oil to the actuator 400 in order to drive the actuator 400 corresponding to the operation signal. FIG. 2 is a diagram schematically illustrating an example of a structure of the oil flow supplying unit 300. Referring to FIG. 2, in the oil flow supplying unit 300, the plurality of pumps 320, for example, five pumps, is connected to each actuator 400 through the valves 310, respectively. Here, the actuator 400 includes a travelling device, an auxiliary device, a swing, a boom, an arm, and a bucket, and oil is supplied and controlled by the oil flow supplying unit 300, so that the actuator 400 is operated.

The pumps of the oil flow supplying unit 300 are disposed as hardware considering the actuator. For example, in the travelling device, there are many cases where left and right motors are mainly simultaneously used, so that in the travelling device, left and right pumps 1 and 4 are basically assigned at left and right motors, respectively. A pump designated so that a change is not generated needs to be assigned to the pump for travelling. Further, the arm and the boom have large loads, so that there may be a case where the two pumps are simultaneously used in order to sufficiently output a speed, and thus two pump modes are included.

In the present exemplary embodiment, as illustrated in FIG. 2, on an assumption that five pumps are provided for the travelling device, the auxiliary device, the swing, the boom, the arm, and the bucket, pumps assignable to the actuators, respectively, according to an operation mode corresponding to the operation signal are exemplified in Table 1.

TABLE 1

| Mode | Swing | Boom | Arm | Bucket | Aux | Tr-R | Tr-L |
|---|---|---|---|---|---|---|---|
| 1 | P3 | | P2 | | P2 | P1 | P4 |
| 2 | P3 | P5 | | | P2 | P1 | P4 |
| 3 | P3 | | | P2 | P2 | P1 | P4 |
| 4 | | P5 | P3 | | P2 | P1 | P4 |
| 5 | | | P3 | P2 | P5 | P1 | P4 |
| 6 | P3 | P5 | P2 | | | P1 | P4 |
| 7 | P3 | | P2 | P5 | | P1 | P4 |
| 8 | P3 | P4 | | P2 | | P1 | P4 |
| 9 | | P4 | P3 | P2 | | P1 | P4 |
| 10 | P3 | P4 | P1 | P5 | P2 | | |
| 11 | P3 | P4 | P1P2 | P5 | | | |
| 12 | P3 | P4P5 | P1 | P2 | | | |

The control unit 200 assigns a pump according to the priority algorithm for each operation by using the table of the assignable pump for each actuator according to an operation mode connected to each actuator.

The assignment of the pump means to control a port of the logic valve so that oil of the pump is supplied to the assigned actuator.

In the priority algorithm for each operation, the travelling device, the auxiliary device, and other actuators have a preferential assignment property in order, and left and right balance is important in the travelling device when the travelling device travels, so that the travelling device has a top priority for assigning a pump and two pumps are assigned to the travelling device.

When a pump is assigned to each actuator, when an operation signal corresponding to the travelling device is input, two pumps are assigned considering the operation signal corresponding to the travelling device as the first order, when an operation signal corresponding to the auxiliary device is input, one pump is assigned considering the operation signal corresponding to the auxiliary device as the second order, when operation signals corresponding to the arm and the boom, respectively, are input, two pumps are assigned depending on a case, when the assignment of the pump is changed according to a change of the operation signal, the pump is assigned to the changed actuator after the oil flow of the pump to be changed becomes 0, and when the number of required pumps in correspondence to the operation signal is equal to or larger than the number of installed pumps, assignment of one pump among the pumps corresponding to the actuator, in which the two pumps are assigned, is changed. For example, on an assumption that a total of five pumps are provided, two pumps are assigned to the boom, one pump is assigned to the arm, one pump is assigned to the bucket, and one pump is assigned to the swing, when a next driving signal of an auxiliary device is input, the two pumps have been assigned to the boom, so that one pump, which has been assigned to the boom, is re-assigned to the auxiliary device.

Figure 3:
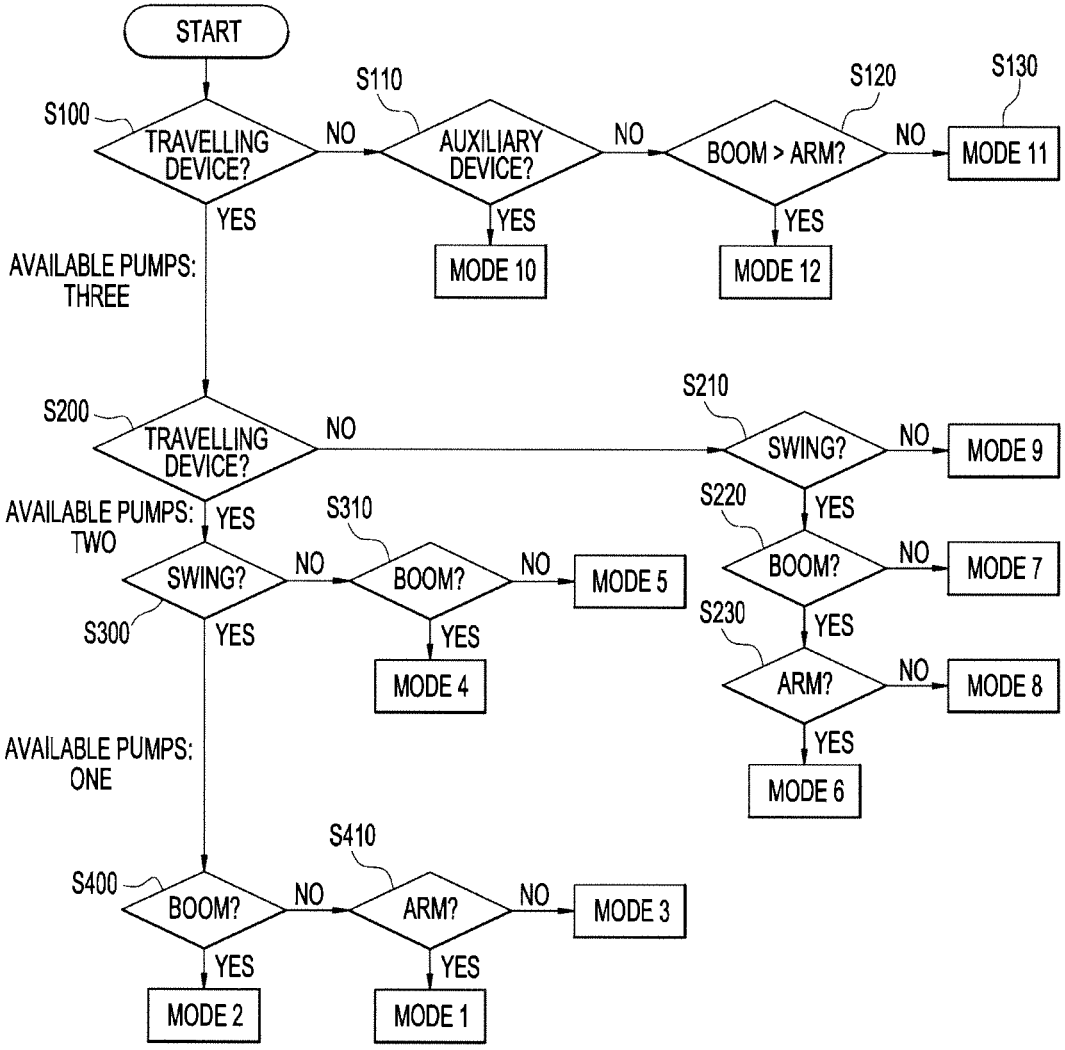
FIG. 3 is a flowchart for describing a method of controlling a hydraulic pump of an excavator according to an exemplary embodiment of the present disclosure.

FIG. 3 is a flowchart for describing a method of controlling a hydraulic pump for an excavator according to an exemplary embodiment of the present disclosure.

A method of controlling the hydraulic pump for the excavator with respect to a change of an operation mode according to an operation signal will be described with reference to FIG. 3. It has been assumed that the number of pumps is five, so that the operation mode will be described with reference to Table 1.

First, it is checked whether an operation signal corresponding to the travelling device having a top priority is input (S100).

When the operation signal corresponding to the travelling device is input in operation S100, two pumps are assigned to the travelling device, and it is checked whether an operation signal corresponding to the auxiliary device is input (S200).

When the operation signal corresponding to the auxiliary device is input in operation S200, one pump is assigned to the auxiliary device, and it is checked whether an operation signal corresponding to the swing is input (S300).

When the operation signal corresponding to the swing is input in operation S300, one pump is assigned to the swing, and it is checked whether an operation signal corresponding to the boom is input (S400).

When the operation signal corresponding to the boom is input in operation S400, a pump to be assigned to each actuator conforms to operation mode 2.

When the operation signal corresponding to the boom is not input in operation S400, it is checked whether an operation signal corresponding to the arm is input (S410).

When the operation signal corresponding to the arm is input in operation S410, a pump to be assigned to each actuator conforms to operation mode 1, and when the operation signal corresponding to the arm is not input in operation S410, a pump to be assigned to each actuator conforms to operation mode 3.

When the operation signal corresponding to the travelling device is not input in operation S100, it is checked whether an operation signal corresponding to the auxiliary device is input (S110).

When the operation signal corresponding to the auxiliary device is input in operation S110, a pump to be assigned to each actuator conforms to operation mode 10.

When the operation signal corresponding to the auxiliary device is not input in operation S110, it is checked whether the operation signal of the boom is larger than the operation signal of the arm (S120).

When the operation signal of the boom is larger than the operation signal of the arm in operation S120, a pump to be assigned to each actuator conforms to operation mode 12, and when the operation signal of the boom is not larger than the operation signal of the arm in operation S120, a pump to be assigned to each actuator conforms to operation mode 11.

When the operation signal corresponding to the auxiliary device is not input in operation S200, it is checked whether an operation signal corresponding to the swing is input (S210).

When the operation signal corresponding to the swing is input in operation S210, it is checked whether an operation signal corresponding to the boom is input (S220).

When the operation signal corresponding to the boom is input in operation S220, it is checked whether an operation signal corresponding to the arm is input (S230).

When the operation signal corresponding to the arm is input in operation S230, a pump to be assigned to each actuator conforms to operation mode 6.

When the operation signal corresponding to the swing is not input in operation S210, a pump to be assigned to each actuator conforms to operation mode 9.

When the operation signal corresponding to the boom is not input in operation S220, a pump to be assigned to each actuator conforms to operation mode 7.

When the operation signal corresponding to the arm is not input in operation S230, a pump to be assigned to each actuator conforms to operation mode 8.

When the operation signal corresponding to the swing is not input in operation S300, it is checked whether an operation signal corresponding to the boom is input (S310).

When the operation signal corresponding to the boom is input in operation S310, a pump to be assigned to each actuator conforms to operation mode 4.

When the operation signal corresponding to the boom is not input in operation S310, a pump to be assigned to each actuator conforms to operation mode 5.

As described above, when the assignment of the pump is changed according to the change of the operation signal, the pump needs to be assigned to the actuator corresponding to the change of the operation signal after the oil of the pump, of which the assignment is to be changed, is sufficiently decreased, for example, the oil becomes 0. The reason is that when the valve is momentarily closed in a state where a discharge of the oil of the pump is left, pressure of the pump is increased, so that a pipe may be damaged or oil may leak.

Further, when the number of pumps required in correspondence to the operation signal is equal to or larger than the number of installed pumps, the assignment of one pump among the pumps corresponding to the actuator, to which two pumps are assigned, is changed.

All of the illustrated operations are not essentially required, and some of the operations may be omitted.

The aforementioned method may be implemented by various means. For example, the exemplary embodiments of the present disclosure will be implemented by hardware, firmware, software, or a combination thereof.

When the exemplary embodiments of the present disclosure are implemented by hardware, the method according to the exemplary embodiments of the present disclosure may be implemented by one or more of application specific integrated circuits (ASICs), digital signal processors (DSPs), digital signal processing devices (DSPDs), programmable logic devices (PLDs), field programmable gate arrays (FPGAs), processors, controllers, microcontrollers, and microprocessors.

When the exemplary embodiments of the present disclosure are implemented by firmware or software, the method according to the exemplary embodiments of the present disclosure may be implemented by a form of a module, a procedure, a function, and the like performing the aforementioned functions or operations. A software code may be stored in a memory unit and driven by a processor. The memory unit may be positioned inside or outside the processor to transceive data with the processor by already publicly known various means.

The exemplary embodiments disclosed in the present specification have been described with reference to the accompanying drawings. As described above, the exemplary embodiments illustrated in the respective drawings shall not be limitedly construed, and it may be construed that the exemplary embodiments may be combined by those skilled in the art fully understanding the contents of the present specification, and when the exemplary embodiments are combined, some constituent elements may be omitted.

Therefore, the embodiments disclosed in the specification and the configurations illustrated in the drawings are just exemplary embodiments disclosed in the present specification and do not fully represent the technical spirit disclosed in the present specification, so that, it should be appreciated that there are various equivalents and modified examples capable of substituting them at the filing date of the present application.

INDUSTRIAL APPLICABILITY

The apparatus and the method of controlling a hydraulic pump according to the present specification may select an actuator, to which oil is to be supplied from a pump by using a logic valve, thereby being used to decrease the number of pumps.

The invention claimed is:

1. An apparatus for controlling a hydraulic pump for an excavator, comprising:

an operating unit generating an operation signal according to an operation of an operator, and including a joystick or a pedal;

an oil flow supplying unit supplying oil to a plurality of actuators, in order to drive the plurality of actuators corresponding to the operation signal, and including a plurality of pumps and a plurality of logic valves; and a control unit controlling the oil flow supplying unit by using a priority algorithm for each operation considering a use frequency and a load of the plurality of actuators with respect to a change of a predetermined operation mode according to the operation signal for the plurality of the actuators;

wherein at least one of the plurality of the actuators comprises a travelling device, and wherein when operation signals for the plurality of actuators are input, and an operation signal corresponding to the travelling device is input, the control unit first assigns two pumps to the travelling device for supplying oil to the travelling device.

2. The apparatus of claim 1, wherein the plurality of the actuators further comprise an auxiliary device, a swing, a boom, an arm, and a bucket, and the logic valves are installed in flow paths connecting the pumps and the actuators, and the control unit assigns the pumps to the actuators by controlling the logic valves.

3. The apparatus of claim 2, wherein when operation signals for the plurality of actuators are input, and an operation signal corresponding to the auxiliary device is input, the control unit first assigns one pump to the auxiliary device.

4. The apparatus of claim 2, wherein when operation signals for the plurality of actuators are input, and operation signals corresponding to the boom and the arm, respectively, are input, the control unit assigns two pumps to the arm or the boom depending on a case.

5. The apparatus of claim 2, wherein when operation signals for the plurality of actuators are input, the control unit assigns the pump to the plurality of actuators with the travelling device as the first order and the auxiliary device as the second order.

6. The apparatus of claim 2, wherein when the assignment of the pump is changed according to a change of the operation signal, the control unit assigns the pump to a changed actuator after a discharged oil of the pump to be changed is exhausted.

7. The apparatus of claim 2, wherein when the number of pumps required in correspondence to the operation signal is equal to or larger than the number of installed pumps, the control unit changes the assignment of one pump among the pumps corresponding to the actuator, to which two pumps are assigned.

8. A method of controlling a hydraulic pump for an excavator with respect to a change of an operation mode according to an operation signal, the method comprising:

checking whether an operation signal corresponding to a travelling device is input;

determining that the operation signal corresponding to the travelling device is input;

preferentially assigning two pumps to the travelling device;

checking whether an operation signal corresponding to an auxiliary device is input;

responsive to determining that the operation signal corresponding to the auxiliary device is input, assigning one pump to the auxiliary device;

checking whether an operation signal corresponding to a swing is input; and responsive to determining that the operation signal corresponding to the swing is input, assigning one pump to the swing.

9. The method of claim 8, further comprising:

checking whether an operation signal corresponding to a boom is input; and responsive to determining that the operation signal corresponding to the boom is input, assigning two pumps to the boom when the number of actuators, which are required to be driven, is smaller than the number of total pumps, and assigning one pump to the boom when the number of actuators, which are required to be driven, is larger than or equal to the number of total pumps.

10. The method of claim 8, further comprising:

checking whether an operation signal corresponding to an arm is input; and responsive to determining that the operation signal corresponding to the arm is input, assigning two pumps to the arm when the number of actuators, which are required to be driven, is smaller than the number of total pumps, and assigning one pump to the arm when the number of actuators, which are required to be driven, is larger than or equal to the number of total pumps.

11. The method of claim 8, further comprising;

checking whether an operation signal corresponding to a bucket is input; and responsive to determining that the operation signal corresponding to the bucket is input, assigning one pump to the bucket.

12. The method of claim 8, further comprising:

changing the assignment of the pump according to a change of the operation signal; and assigning the pump to an actuator corresponding to the change of the operation signal after an oil flow of the pump, of which the assignment is to be changed, is exhausted.

13. The method of claim 12, further comprising changing the assignment of one pump for an actuator, to which two pumps are assigned when the number of pumps required in correspondence to the operation signal is equal to or larger than the number of installed pumps.

* * * * *